United States Patent [19]

Weir

[11] 4,383,793

[45] May 17, 1983

[54] TRACTOR IMPLEMENT MOUNT

[75] Inventor: Norman F. Weir, Calument, Wis.

[73] Assignee: Chromalloy American Corporation, St. Louis, Mo.

[21] Appl. No.: 238,425

[22] Filed: Feb. 26, 1981

[51] Int. Cl.[3] ..... E02F 3/72

[52] U.S. Cl. ..... 414/686; 37/117.5; 403/14; 403/161

[58] Field of Search ..... 414/686, 724; 37/117.5; 172/272–275; 403/14, 161, 378, 379

[56] References Cited

U.S. PATENT DOCUMENTS

| | | | |
|---|---|---|---|
| 1,971,200 | 8/1934 | Proctor | 403/14 |
| 3,324,954 | 6/1967 | Westendorf | 414/686 X |
| 3,805,980 | 4/1974 | Kisaka | 414/686 |
| 3,837,679 | 9/1974 | Dickmann | 172/275 X |
| 3,863,786 | 2/1975 | Frank | 414/686 |
| 4,033,469 | 7/1977 | Frank | 414/686 |

*Primary Examiner*—Robert J. Spar
*Assistant Examiner*—Terrance L. Siemens
*Attorney, Agent, or Firm*—Haverstock, Garrett & Roberts

[57] ABSTRACT

This invention relates to an improved tractor front end implement mount adaptable for rapid attachment and detachment by a single person. This invention is characterized by a working implement having a pair of lift frame arm assemblies coupled in working relationship with intermediate frame members, the intermediate frame members being attachable to support structures attached to the tractor for mounting an implement thereto. Pockets are formed on the outer extremities of the support structures which extend outwardly from opposite sides of the tractor and are adaptable for catching and retaining the rear end portion of the respective intermediate frame members until the intermediate frame members can be pivotally attached thereto by pins. The invention is further characterized by the use of multiple diameter configuration pins which are tapered at the ends and adapted to fit into snug fitting relationship with openings in the pockets and in the intermediate frame members. Rigid detachable leg members are removably attached to the lift frame arm assemblies on each side of the working implement to hold it in an upright position when detached from the tractor.

17 Claims, 6 Drawing Figures

TRACTOR IMPLEMENT MOUNT

BACKGROUND OF THE INVENTION

This invention relates to a quick detach and attach means and a system for mounting implements, such as power loaders, on prime movers and agricultural and other light industrial tractors, which tractors are most generally of the utility type configuration but not necessarily always so. The present invention facilitates the quick removal and replacement of all such implements. A tractor or prime mover is a highly useful and greatly utilized machine which can have many different tools or implements attached or hooked thereto, and/or mounted thereon, for performing a wide variety of tasks. Typical of such implements is a power loader which is a heavy tool that is normally mounted directly onto the tractor and often utilizes attaching points also useful for the attachment or other tools and implements. Often times the use of the tractor is limited to the extent that the power loader or other implement must be removed from time to time in order to permit use of the tractor for other required work. An implement such as a power loader that is mounted on a tractor by normal means is difficult and time consuming to dismantle and remove and it is likewise equally difficult to reassemble or reattach such implement to the tractor.

It is therefore recognized that a system is needed for the quick removal with ease of the major portion of an implement, especially a power implement such as a front end power loader. If total removal of the implement is required, the support means that is attached to the tractor must be within the ability of an individual or handle with ease. Likewise, it is essential that replacement of the implement onto the tractor or prime mover be quick and easy. It is further recognized that when the implement is removed, a safe and sturdy means of support must be provided as an aid for its removal and for its storage thereafter in a manner that would preclude the possibility of accidental tipping or collapse. The construction of the device must also permit quick removal and replacement of the implement without affecting the strength and rigidity of the implement when it is attached to the tractor thereby permitting such implement to be every bit as effective, strong, rigid, and long lasting as a conventionally attached implement, for example, a power loader. A further requirement is that the means and system devised for accomplishing this task must allow for retention of the conventional implement type construction and style for aesthetic reasons and must not be a cause for radical departure therefrom. In addition, it must be compatible with the majority of the utility style tractor chassis as found in use today.

U.S. Pat. No. 3,324,954 discloses a loader device adapted for mounting on a farm tractor characterized by the customary frame for the loader and attachment to the tractor, the bucket being maneuvered by means of hydraulic power from the tractor. This patent discloses prongs to guide the attaching means into a cone shaped structure where the attaching means is locked into place.

U.S. Pat. No. 3,805,980 discloses a device for attaching a front end loader to a tractor having particular connection means pivotally connecting lift arms to bed plate means mounted on the body of the tractor. This patent describes heavy mounting brackets mounted on a heavy base plate characterized by having the forward facing portion of the outer and upward sections cut out in order to receive the arms of the apparatus, presumably so that the arms would slide into the cut outs in the mounting brackets.

U.S. Pat. Nos. 4,033,469 and 3,939,997 disclose a tractor mounted implement device characterized by downward and forward guide support channels extending across the front end for engagement with the transversely extending portion of a U-shaped frame, and a support stand connected to the forward end of the U-shaped frame.

U.S. Pat. No. 4,065,009 discloses a quick attachment front end loader for agricultural tractors characterized by sockets and guides to receive the various supporting members which are in the form of rods. The loader becomes supported on the tractor merely by driving the tractor forward until all of the rod members are received in the sockets. This reference also discloses a parking stand comprised of fixed legs braced by struts and a pair of adjustable legs having feet.

BRIEF SUMMARY OF THE INVENTION

This invention relates generally to an improved tractor front end implement mount and, more particularly, to quick detach means for front end loaders for tractors, such as farm tractors, which includes a bucket or similar working tool, a pair of lift frame arm assemblies to support the bucket, hydraulic cylinders attached to the bucket and to the lift frame arm assemblies to rotate the bucket for filling and emptying purposes, a pair of intermediate frame members to which the lift frame assemblies are pivotally attached so that the bucket may be lifted thereby, hydraulic cylinders attached to the intermediate frame members and to the lift frame arm assemblies to cause said assemblies to be lifted and lowered along with the bucket, a pair of support means attached to the tractor for mounting the intermediate frame members thereto, and removable leg members attached to the lift frame arm assemblies to support the structure in a detached position. The novel elements of the present invention comprise support means which extend outwardly from opposite sides of the tractor having pockets formed on the outer extremities thereof adapted for catching and retaining the rear end portion of the respective intermediate frame members until such intermediate frame members can be pivotally attached thereto by means of attachment pins; the use of a pair of two diameter configuration attachment pins which are tapered at each end portion and adapted to fit into snug fitting relationship simultaneously with an aperture on the outside wall of each pocket adapted to accommodate the larger diameter portion of the attachment pin and an aperture on the inner wall of each pocket adapted to accommodate the smaller diameter portion of the attachment pin; each of the two diameter configuration pins having means associated with the smaller diameter end portion thereof for retaining it in its proper position such as another pin, a key, or a threaded nut; bushings on the rear end portion of each of the intermediate frame members adapted to work in cooperation with said attachment pins having an outer aperture substantially the same size as the larger or outer portion of the two diameter tapered pin and having an inner aperture substantially the same size as the smaller or inner portion of the two diameter tapered pin; and a pair of rigid detachable leg members attachable to the lift frame structure of the implement to hold said implement in an upright position when detached from the tractor. The temporary support leg members may be pivotally or rigidly attached to the lift frame arm assemblies, although it is preferable that the leg members be attached in a fixed, rigid position. It should be noted that the leg members may be of a fixed length or of a telescoping type construction, and will generally be attached to the center portion of the lift frame arm assemblies at the upper extremities thereof.

It is therefore a principal object of the present invention to provide a safe, quick and efficient means for attaching and detaching a wide variety of front end implements to a conventional utility type tractor.

Another object is to provide a means for rapid attachment and detachment of an implement to a tractor by a single person.

Another object is to teach the construction of a system for mounting implements on agricultural and other utility type tractors which include support means for aiding in the removal of the implement from the tractor and for its storage thereafter.

Another object is to provide an improved tractor implement mount which is relatively simple structurally and requires relatively little maintenance.

These and other objects and advantages of the present invention will be apparent to those skilled in the art after considering the following detailed specification in conjunction with the accompanying drawings.

BRIEF DESCRIPTION OF THE DRAWINGS

In the drawings which illustrate an embodiment of the present invention.

DESCRIPTION OF THE PREFERRED EMBODIMENT

Figure 1:
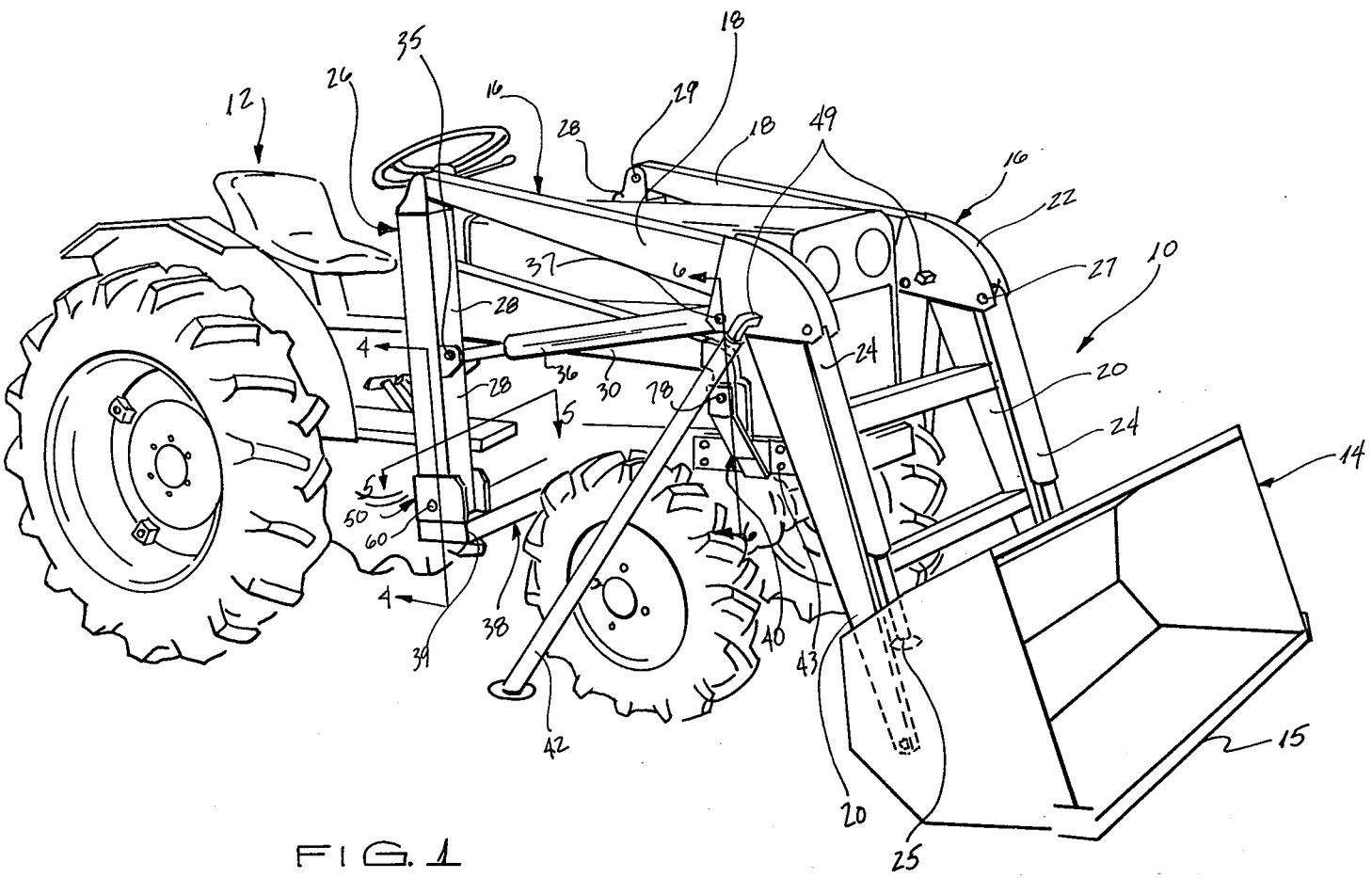
FIG. 1 is a perspective view of a farm tractor utilizing the present implement mount for attaching a front end loader thereto.

Referring to the drawings more particularly by reference numbers and wherein like numerals refer to like parts, FIG. 1 illustrates a front end implement or power loader 10 mounted to a conventional tractor 12 according to the teachings of the present invention. The loader 10 illustrated with this invention is comprised of all the normal and usual elements found in a power loader attachment for tractors including a bucket 14; a pair of lift frame arm assemblies 16 to support the bucket 14 which is pivotally attached thereto; hydraulic cylinders 24 attached to the bucket 14 and to the lift frame arm assemblies 16 to rotate the bucket for filling and emptying purposes; a pair of intermediate frame members 26 to which the lift frame assemblies 16 are pivotally attached so that the bucket may be lifted thereby; and a pair of hydraulic cylinders 36 attachable to both the intermediate frame members 26 and the lift frame assemblies 16 for raising and lowering the lift frame assemblies along with the bucket 14 attached thereto for purposes of maneuvering the bucket as is normally required during power loader work. In particular, the present invention resides in a pair of support or attachment means 38 and a pair of front attachment means 40, both of which are rigidly attached to the tractor structure to which the intermediate frame members 16 are attached by a quick detachable means to permit quick and easy temporary removal of the entire loader assembly 10 from the tractor 12. This is important because it frees the tractor for other needed tasks yet permits the same quick and easy replacement of the aforementioned loader or other implement for the resumption of loader work. A means of support in the form of detachable leg members 42 are attachable to the lift frame arm assemblies 16 so as to permit the entire loader assembly 10 to be removed and properly supported thereafter once the loader or any other implement is completely detached from the tractor.

Figure 2:
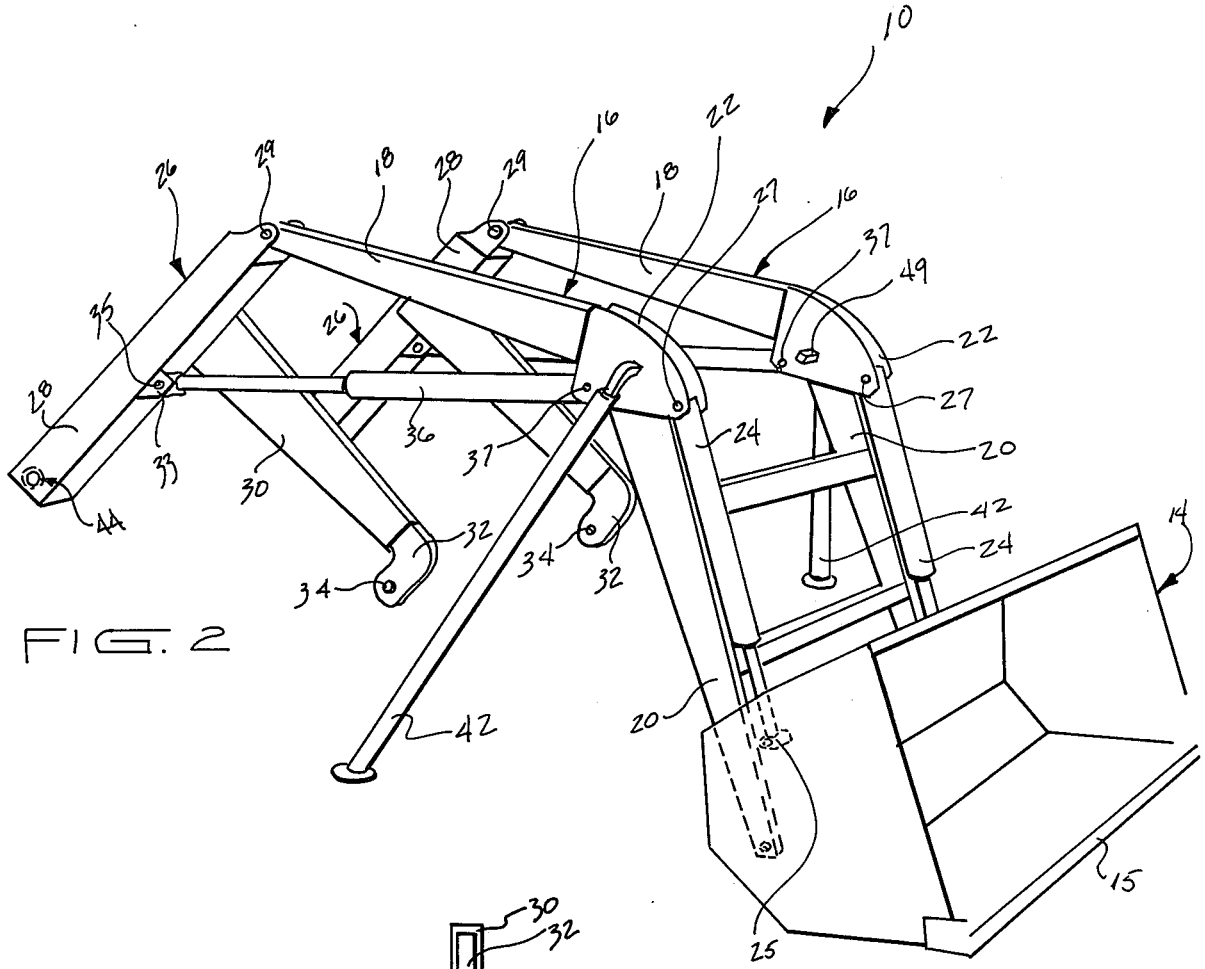
FIG. 2 is a perspective view of the loader of FIG. 1 detached from the tractor.

Each of the lift frame arm assemblies 16 include arm members 18 and 20 respectively which are interconnected by any suitable connecting means such as the bracket member 22 shown in FIGS. 1 and 2. Hydraulic cylinders 24 are each attached at one end portion thereof to the bucket 14 as at 25 and have their opposite end portions attached to bracket members 22 as at 27 (FIGS. 1 and 2). Although it is anticipated that the lift frame arm assemblies 16 can be easily fabricated from component parts such as members 18, 20 and 22 which can be assembled into a unitary structural configuration as shown in FIGS. 1 and 2, it is likewise anticipated that they can be conveniently molded into a unitary structure eliminating the need for the assembly of component parts.

Each of the intermediate frame members 26 includes an arm member 28 having means associated with one end portion thereof for pivotally attaching one end portion of the lift arm member 18 thereto. Any well known suitable means for pivotally attaching arm member 18 to arm member 28 may be utilized such as the pivot pin member 29 shown in FIG. 2. The opposite end portion of arm members 28 each may include a bushing 44 which may be permanently affixed to and remain a part of members 28 for cooperatively engaging support means 38 as will be hereinafter explained. Each bushing 44 is of a two diameter configuration having apertures 46 and 48 (FIGS. 4 and 5) wherein the diameter of aperture 46 is greater than the diameter of aperture 48, the bushing housing having a very liberal taper therewithin between apertures 46 and 48 such as at 47. In addition, each of the intermediate frame members 26 also includes an angularly disposed support arm member 30 which is preferably integrally formed with member 28 at one end portion thereof and extends forwardly therefrom as shown in FIG. 2. Support arm members 30 also include downwardly extending flange projections 32 having apertures 34 therethrough for rigidly attaching said members to the front attachment means 40 as will be hereinafter explained. This is important to the present invention because the engagement of support arm members 30 with the pair of front attachment means 40 provides additional stability and rigidity to the entire loader assembly 10 and greatly facilitates the easy attachment and detachment of the loader or any other implement to and from the tractor. It should also be noted that hydraulic cylinders 36 are likewise pivotally attached at one end portion thereof to an additional bracket member 33 by any suitable pivot means such as by pivot pin member 35 (FIGS. 1 and 2) and have their opposite end portions similarly attached to bracket members 22 as at 37.

Figure 3:
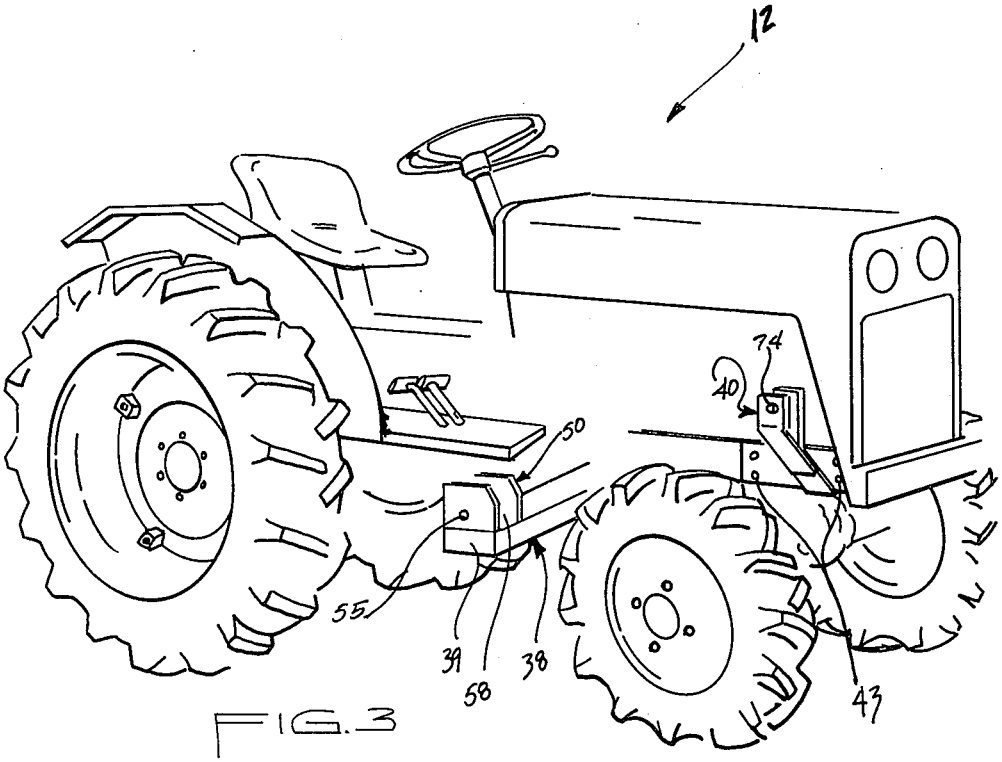
FIG. 3 is a perspective view of a farm tractor showing a pocket formed on the outer extremity of one of the support means and front attachment means, both of which are rigidly attached to the tractor structure.
Figure 4:
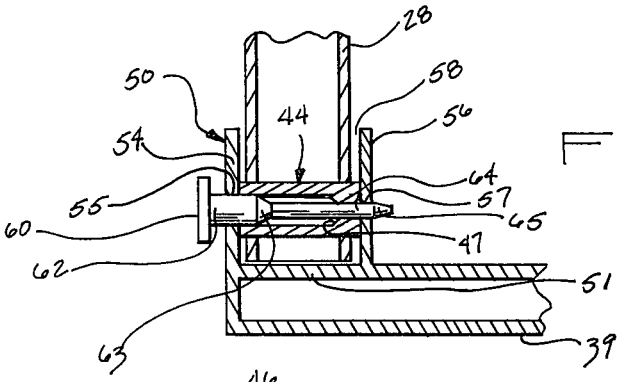
FIG. 4 is a cross section taken along the lines 4—4 of FIG. 1.
Figure 5:
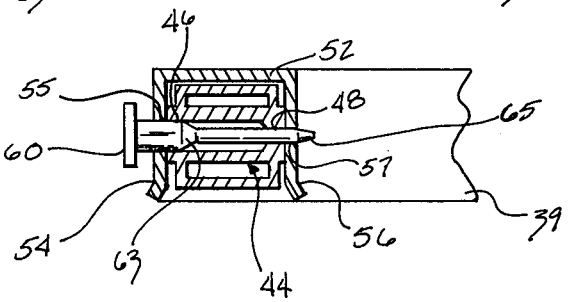
FIG. 5 is a cross section taken along the lines 5—5 of FIG. 1.

FIGS. 4 and 5 illustrate how the arm members 28 of the intermediate frame members 26 are secured to the pair of support means 38 which are each sturdily affixed to the tractor 12 in any conventional manner and extend outwardly in opposite directions therefrom as shown in FIGS. 1 and 3. Each support means 38 includes a support member 39 having a vertically disposed pocket 50 formed near the outermost edge portion thereof for cooperatively receiving the rear end portion of arm member 28 and the bushing 44 therein. The pockets 50 are substantially U-shaped in configuration, each having a bottom wall 51, a back wall 52, and side walls 54 and 56 extending forwardly from back wall 52 respectively as shown in FIGS. 1, 3 and 5. Wall members 51, 52, 54 and 56 form an opening 58 therebetween as illustrated in FIGS. 1 and 3 into which the rear end portion of arm member 28 closely but yet somewhat loosely fits therewithin for attachment thereto. Bottom wall 51 may be formed by the outermost edge portion of each support member 39 as shown in FIG. 4 or it may be integrally formed with members 52, 54 and 56. The pockets 50 are important because they permit free and easy entry and removal of the arm members 28 for quick attachment to and detachment from the tractor 12. A pair of two diameter attachment pins 60 compatible for insertion into and engagement with the two diameter configuration bushings 44 are utilized to pivotally mount arm members 28 within the respective pockets 50. The attachment pins 60 include a first portion 62 of constant diameter and a second portion 64 of constant diameter wherein the diameter of the first portion 62 is greater than the diameter of the second portion 64, the pin 60 having a very liberal taper at the transition point 63 therebetween. The angle of the taper at the transition point 63 is not critical and will usually range from 15° to 45°. It should be noted that the diameter of the first portion 62 of pin 60 is substantially equal to the diameter of aperture 46 in bushing 44 and the diameter of the second portion 64 of pin 60 is likewise substantially equal to the diameter of aperture 48 in bushing 44. In similar fashion, the outer side wall 54 of each pocket 50 includes an aperture 55 substantially equal in diameter to pin portion 62 and aperture 46 and the inner side wall 56 of each pocket 50 includes an aperture 57 substantially equal in diameter to pin portion 64 and aperture 48. When arm members 28 are placed within their respective pockets 50, the members 28 rest on bottom wall 51 and/or support member 39 within the respective pockets 50 prior to the insertion of pins 60, and the apertures 46, 48, 55 and 57 are in such reasonable alignment that the second portions 64 of attachment pins 60 may be readily inserted in a transverse direction through the outer apertures 55, through the bushings 44, and almost nearly through the inner apertures 57 before a tight fitting contact between the attachment pins 60 and the apertures through which they passed is achieved. It is important to note that the transition point 63 of each attachment pin 60 occurs somewhere between the apertures 55, through the bushings 44, and almost nearly through the inner apertures 57 before a tight fitting contact between the attachment pins 60 and the apertures through which they passed is achieved. It is important to note that the transition point 63 of each attachment pin 60 occurs somewhere between the apertures 46 and 48 of the bushing 44 to insure proper engagement with the pockets 50 and the bushings 44. In addition, the end portion 65 of each pin 60 is likewise liberally tapered to facilitate insertion of such pins within their respective apertures.

The two diameter attachment pins 60, which may be inserted freely and with virtually no contact for about ninety percent of their length before making contact with the diameters that they are intended to fit, can then be easily pushed into final position during which time the respective tapers on the attachment pins 60 will draw the arm members 28 from their rest positions wherein they are resting on bottom wall members 51 and/or support members 39 in pockets 50 into positions wherein they are being solely supported by pins 60 in such a manner that arm members 28 are rigid to any sideward (transverse) movement and can only pivotally rotate about attachment pins 60 in a fore and aft direction. After insertion, attachment pins 60 are retained therein by any suitable means such as keys, pins, nuts, and other similar known devices.

Figure 6:
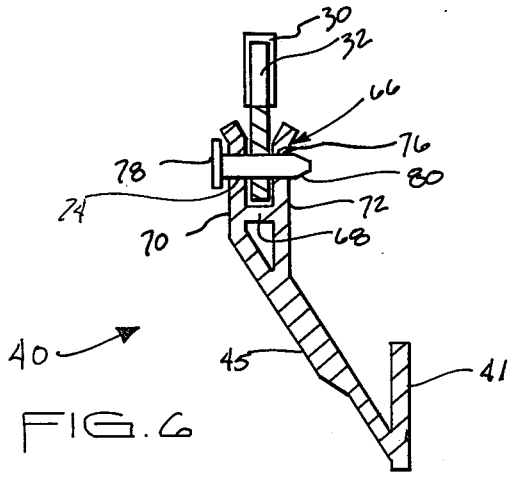
FIG. 6 is a cross section of the front attachment means taken along the lines 6—6 of FIG. 1.

FIG. 6 illustrates how the forwardly extending support arm members 30 of intermediate frame members 26 are secured to a pair of front attachment means 40 which, similar to support means 38, are sturdily affixed to the tractor in any conventional manner and normally remain on the tractor at all times. Each front attachment means 40 includes a base plate 41 adapted for mounting to the tractor by conventional fastening means such as members 43 (FIGS. 1 and 3) having an upwardly extending angularly disposed flange member 45 attached thereto or integrally formed therewith which terminates at its upper end portion into a vertical fork or channel-shaped bracket member 66. Bracket members 66 are likewise substantially U-shaped in configuration, each having a bottom wall 68 and side walls 70 and 72 projecting upwardly therefrom respectively as shown in FIG. 6. Side walls 70 and 72 include apertures 74 and 76 respectively adapted to receive a pin 78 therethrough. The bracket members 66 are adapted to receive the flange projections 32 of support arm members 30 when members 30 are placed therebetween and they allow the projections 32 to rest upon the bottom walls 68 in such a position that the apertures 74, 76 and 34 which are intended to receive the pin 78 are nearly in alignment. The final alignment of apertures 74, 76 and 34 may be made by hooking up the hydraulic system and thereafter moving the intended arm member 28 into proper alignment with the respective apertures extending through the pockets 50 and inserting the pins 60 therethrough. It is important to note that as pins 60 are slidably inserted through apertures 46, 48, 55 and 57, the transition point 63 engages the periphery of aperture 46 and guides apertures 46 and 48 into alignment with the apertures 55 and 57 on side walls 54 and 56. This guiding action enables the first portion 62 of pin 60 to engage the aperture 46 and further enables the second portion 64 of pin 60 to engage the apertures 48 and 57 thereby detachably securing arm member 28 to support means 38. The insertion of pins 60 through the respective apertures extending through pockets 50 and arm members 28 facilitates the movement of apertures 34 in arm members 30 into alignment with apertures 74 and 76 for the insertion of pins 78 therethrough. The use of pins 60 in conjunction with support means 38 and front attachment means 40 provides a relatively simple system and method for enabling a single person to quickly attach and detach a working implement to a tractor or other prime mover.

The pins 78 are generally of standard uniform diameter. However, the pins 78 may have a tapered point 80 adapted to facilitate the passage of said pins through the apertures 74 and 76 of the channel-shaped bracket members 66 and through the apertures 34 located on the flange projections 32 thereby supporting the intermediate arm members 30 slightly above the bottom walls 68 and eliminating any transverse movement yet permitting fore and aft rotational movement as aforementioned. Pins 78, after insertion, are likewise retained by any suitable means such as keys, pins, nuts, and other similar known devices.

Having described how this invention retains the power loader 10 or any other implement securely and rigidly on the tractor and how, by the extraction of four pins, it can be quickly released from the tractor, rigid detachable leg members 42 are provided for safe storage during the time the loader or other implement is not in use on the tractor. The leg members 42 may be pivotally or rigidly attached to the lift frame arm assemblies near the center thereof such as at 49 on bracket members 22 (FIGS. 1 and 2). It has been found that for the greatest safety and in order to substantially reduce the possible collapse of the removed power loader assembly 10, it is preferable that the leg members 42 be attached in a fixed and rigid but easily removable position. Any well known suitable means for attaching the leg members 42 in rigid relationship with the bracket members 22 of the lift frame arm assemblies 16 may be utlized. Typical of such means includes a shaft pinned in a socket, a shaft keyed in a hole, and other similar means known in the art. The leg members 42 may be made of a fixed length, or they may be made so as to be telescopingly extendible to accommodate some terrain unevenness. In addition, leg members of a telescoping type construction are readily collapsible and facilitate their placement in some storage locations on the power loader when not being utilized for their intended purposes.

In order to detach the power loader 10 or other implement from the tractor 12, lift frame arm assemblies 16 need only be raised sufficiently to allow leg members 42 to be attached thereto. The lift frame arm assemblies are then lowered so that they are supported by leg members 42 such that the bucket 14 does not rest upon the ground surface but is elevated several inches thereabove. Bucket 14 is then rotated in such a direction as if it were to be emptied (dumped) until the forward end or cutting lip 15 is firmly in contact with the ground surface. Pins 60 and 78 are then removed and the power loader 10 remains supported in the pockets 50 of the support means 38 and the bottom wall 68 of bracket members 66 as well as by the detachable leg members 42 and the bucket 14. The bucket 14 may then be rotated in such a direction as if the bucket were to retain a load, which action will cause the forward portions of lift frame arm assemblies 16 to lower thereby allowing the rear portions of the intermediate frame members 26 including bushings 44 and flange projections 32 to rise free of their respective support means 38 and 40. The tractor 12 may then be backed away slowly as members 28 and 30 are pivotally rotated to gain clearance for such members to pass over the front wheels of the tractor. When sufficient clearance is noted, the tractor may be stopped and the hydraulic oil supply lines to the power loader may be disconnected via hydraulic quick disconnect couplers and the tractor may then be completely backed away from the power loader leaving the loader 10 in a fully supported upright position as shown in FIG. 2.

The reattaching of the loader 10 to the tractor 12 may be accomplished by reversing the above described procedure. Removal of the implement may be accomplished in as little as one and a half minutes and reattaching may be accomplished in as little as two and a half minutes. The reason for the reduced attaching and detaching times is the rapid means by which pins 60 and 78 can be either inserted or extracted. Slightly longer reattachment times may be required since the tractor 12 must be carefully steered as it is driven forwardly into the power loader assembly. The pockets 50 on the support means 38 receive arm members 28 therewithin and align them so that the flange projections 32 of support arm members 30 also come into proper engagement in the front attachment means 40, all in readiness for the quick replacement of pins 60 and 78. It should be noted that the attachment pins 60 are expressly made with at least two diameters with large liberal tapers at the transition point so that its extraction can be accomplished by driving it back with any suitable object until its protruding end is almost flush with the hole surface, at which point the respective diameters have moved out of their engagement diameters and the pins are totally free for removal therefrom.

Although this invention has been described with reference to a power loader 10, it will work equally as well with other tractor mounted implements such as back hoes, cultivators, planters, and other similar front end attachment devices.

Thus there has been shown and described a novel quick detach means for power loaders and other implements and a method of use which fulfills all of the objects and advantages sought therefor. It will be apparent to those skilled in the art, however, that many changes, modifications, variations, and other uses and applications for the subject device are possible. All such changes modifications, variations and other uses and applications which do not depart from the spirit and scope of the invention are deemed to be covered by the invention which is limited only by the claims which follow.

What is claimed is:

1. A mounting assembly for attaching to the frame assembly of a prime mover a working implement having attachment members thereon comprising first and second pairs of attachment structures on the frame assembly of said prime mover, each of said pairs of attachment structures including means associated therewith for receiving and engaging corresponding attachment members on said working implement, alignment means associated with said first pair of attachment structures for aligning said second pair of attachment structures with their corresponding attachment members on said working implement when the first pair of attachment structures are secured to their corresponding attachment members on said working implement, and locking means for detachably securing the attachment members on said working implement to said first and second pairs of attachment structures;

wherein said first pair of attachment structures on the frame assembly of said prime mover includes a pair of first support members attached respectively to opposite sides of said prime mover and extending outwardly therefrom, said means associated with said first pair of attachment structures for receiving and engaging the corresponding attachment members on said working implement including pocket means formed on the outer extremity of each of said support members, said pocket means including first and second opposed side wall members having openings extending respectively therethrough for alignment with corresponding openings extending through corresponding attachment members on said working implement and wherein said second pair of attachment structures on the frame assembly of said prime mover includes a pair of second support members attached respectively to opposite sides of said prime mover and extending upwardly therefrom, each of said second support members positioned in spaced apart relationship relative to said first support members, said means associated with said second pair of attachment structures for receiving and engaging the corresponding attachment members on said working implement including bracket means on said second support members, said bracket means including first and second opposed side wall members having openings extending respectively therethrough for alignment with corresponding openings extending through corresponding attachment members of said working implement; and wherein said alignment means associated with said first pair of attachment structures includes a first pin member slidably insertable within said openings extending through said pocket means and the corresponding attachment members on said working implement such that when said first pin member is inserted therethrough the openings extending through the bracket means on said second support members are drawn into alignment with the openings extending through their corresponding attachment members on said working implement to permit attachment thereto, said first pin member including first and second portions having different diameters and a tapered transition region extending therebetween, said first pin portion being of constant diameter and substantially equal to the diameter of the openings extending through the first side wall member of said pocket means, said second pin portion being of constant diameter and substantially equal to the diameter of the opening extending through the second side wall member of said pocket means.

2. The mounting assembly defined in claim 1 wherein the locking means for detachably securing the corresponding attachment members on said working implement to said first pair of attachment structures includes said first pin member.

3. The mounting assembly defined in claim 1 wherein said alignment means associated with said pair of first support members includes a first pin member slidably extendible through the first and second openings of said pocket and the opening extending through the corresponding attachment member on said working implement such that when said first pin member is inserted therethrough the opening extending through the corresponding attachment members on said working implement are moved into alignment with the openings extending through said channel-shaped bracket to permit attachment thereto, said first pin member having a first portion of constant diameter substantially equal to the diameter of the first opening extending through said pocket and a second portion of constant diameter substantially equal to the diameter of the second opening extending through said pocket, said first and second portions of said first pin member having a tapered transition region extending therebetween.

4. The mounting assembly defined in claim 3 wherein the locking means for detachably securing the corresponding attachment members on said working implement to said pair of first support members includes said first pin member.

5. The mounting assembly defined in claim 3 wherein the openings extending through each of the attachment members on said working implement through which said first pin member is inserted therethrough includes a bushing member having a first portion adaptable to receive and engage the first portion of said first pin member and a second portion adaptable to receive and engage the second portion of said first pin member.

6. The mounting assembly defined in claim 1 wherein said vertically disposed pockets are substantially U-shaped in configuration and open forwardly for receiving said frame assemblies.

7. A mounting assembly for use on a tractor adapted for engagement with a pair of frame arm assemblies on a working implement, said mounting assembly comprising first attachment means including a pair of first support members attached respectively to opposite sides of said tractor and extending outwardly therefrom, each of said first support members having a vertically disposed pocket formed on the outer extremity thereof for receiving and retaining one of said frame arm assemblies therewithin, said pocket including first and second spaced opposed side wall members each of which having an opening extending respectively therethrough, said opening extending through said first side wall member having a greater diameter than said opening extending through said second side wall member, each of said frame arm assemblies having an opening extending therethrough such that when the frame arm assemblies are positioned within their respective pockets their respective openings are in near alignment with the openings extending through said pockets, a first pin member insertable within the respective openings extending through said pockets and said frame arm assemblies for detachably securing said frame arm assemblies to said first attachment means, said first pin member including first and second portions of different diameter having a tapered transition region extending therebetween, said first pin portion being of constant diameter and substantially equal to the diameter of the opening extending through the first side wall member of said pocket, said second pin portion being of constant diameter and substantially equal to the diameter of the opening extending through the second side wall member of said pocket, second attachment means including a pair of second support members attached respectively to opposite sides of said tractor positioned in spaced apart relationship relative to said first support members, each of said second support members including channel-shaped bracket means adapted for receiving and retaining said corresponding frame arm assemblies therewithin, said bracket means having openings extending respectively therethrough such that said openings are in near alignment with openings extending through the corresponding frame arm assemblies when said assemblies are positioned within said channel-shaped bracket means, said openings extending through the corresponding frame arm assemblies being moved into alignment with said openings extending through said bracket means when said first pin member is insertably engaged with the respective openings extending through said first attachment means and said frame arm assemblies, and a second pin member insertable within the respective openings extending through said bracket means and said frame arm assemblies for detachably securing said frame arm assemblies to said second attachment means.

8. The mounting assembly defined in claim 7 wherein the openings extending through each frame arm assembly through which said first pin member is inserted includes a bushing member, said bushing member having a first portion adaptable to receive and engage the first portion of said first pin member and a second portion adaptable to receive and engage the second portion of said first pin member.

9. The mounting assembly defined in claim 7 including a pair of leg members removably attachable to said working implement to permit said implement to be removed and supported thereon after detachment from said tractor.

10. The mounting assembly defined in claim 9 wherein each of said leg members include means for selectively adjusting the length of said members.

11. The mounting assembly defined in claim 9 wherein said frame arm assemblies include openings therein adapted to hold said leg members in position to operably support said working implement when detached from said tractor.

12. The mounting assembly defined in claim 7 wherein said vertically disposed pockets are substantially U-shaped in configuration and open forwardly for receiving said frame arm assemblies.

13. In a mounting assembly for attaching and detaching a front end working implement to a tractor, said implement including a pair of frame assemblies having first and second arm members associated respectively therewith, each of said first and second arm members respectively including an opening extending therethrough for engagement with said mounting assembly, the improvement comprising a pair of first support members attached respectively to opposite sides of said tractor and extending outwardly therefrom, each of said first support members having a pocket formed on the outer extremity thereof adapted for receiving and retaining the first arm members of said pair of frame assemblies therewithin, said pocket being substantially U-shaped in configuration having a bottom wall member, a back wall member and first and second side wall members extending forwardly therefrom, said first and second side wall members having openings extending respectively therethrough wherein the opening through said first side wall member is greater in diameter than the opening through said second side wall member, said first arm members being positioned within their respective pockets such that the openings through said first and second side wall members are in near alignment with the openings associated with the first arm members of said frame assemblies, a first pin member insertable within the respective openings extending through said first and second side wall members and the first arm members of said frame assemblies for removably attaching said first arm members to their respective pockets, said improvement further comprising a pair of second support members attached respectively to opposite sides of said tractor and extending upwardly therefrom, each of said second support members being positioned in spaced apart relationship relative to said first support members and including bracket means thereon adapted for receiving and retaining the second arm members of said frame assemblies therewithin, said bracket means having openings extending therethrough such that said openings are in near alignment with the corresponding openings in said second arm members when said members are positioned therewithin, alignment means on said first pin member for aligning the openings on said second arm members with the openings extending through said bracket means when said first pin member is engaged with said first support members and the first arm members of said frame assemblies, a second pin member insertable within the openings in said bracket means and through the respective openings in said second arm members for removably attaching said second arm members to said bracket means, and a pair of leg members removably attachable to the frame assemblies of said working implement in positions to permit said implement to be removed and supported thereon after detachment from said tractor.

14. The improvement defined in claim 13 wherein said alignment means on said first pin member includes first and second pin portions having different diameters and a tapered transition area extending therebetween, said first pin portion being of constant diameter and substantially equal to the diameter of the opening extending through the first side wall member of said pocket, said second pin portion being of constant diameter and substantially equal to the diameter of the opening extending through the second side wall member of said pocket.

15. Tractor mounting means adaptable for engagement with a front end working implement, said implement including a pair of frame attachment assemblies having first and second arm members, each of said first and second arm members having an opening extending therethrough respectively adapted for attachment to said mounting means, said mounting means comprising a pair of first support members attached respectively to opposite sides of said tractor and extending outwardly therefrom, each of said first support members having vertically disposed U-shaped pocket means formed on the outer extremity thereof adapted for receiving and retaining the respective first arm members of said frame assemblies therewithin, said pocket means including spaced opposed side wall portions having openings extending respectively therethrough, said opening through one of said opposed side wall portions being greater in diameter than the opening extending through said other side wall portion, a first pin member adapted for insertion through the respective openings in said pocket means and said first arm members for detachably securing said arm members to said first support members, said first pin member having a first portion of constant diameter and a second portion of constant diameter and a tapered transition area extending therebetween, said first pin portion being substantially equal to and slidably engageable with the opening extending through one of the opposed side wall portions of said pocket means and said second pin portion being substantially equal to and slidably engageable with the opening extending through the other opposed side wall portion of said pocket means, said mounting means further comprising a pair of second support members attached respectively to opposite sides of said tractor and extending upwardly therefrom, each of said second support members being positioned in spaced apart relationship forward of said first support members, each of said second support members including channel-shaped bracket means for receiving and retaining the respective second arm members of said frame assemblies therewithin, said channel-shaped bracket means having openings extending respectively therethrough, said openings in each of said second arm members being moved into alignment with the openings extending through said channel-shaped bracket means during insertion of said first pin member through the respective openings of said pocket means and said first arm members to permit attachment thereto, a second pin member adapted for insertion through the respective openings in said channel-shaped bracket means and said second arm members for detachably securing said second arm members to said second support members, and a pair of rigid leg members removably attachable to said working implement in positions to permit said implement to be removed and supported thereon after detachment from the tractor.

16. The tractor mounting means defined in claim 15 wherein each of said leg members include means for selectively adjusting the length of said members to accommodate different terrain.

17. The tractor mounting means defined in claim 15 wherein the openings extending through each of the first arm members of said frame attachment assemblies include a bushing member adaptable to receive said first pin member therethrough.

* * * * *